US008833601B2

(12) United States Patent
Zacherle et al.

(10) Patent No.: US 8,833,601 B2
(45) Date of Patent: Sep. 16, 2014

(54) PRODUCT DISPENSING SYSTEM WITH STAGGERED PERFORATIONS

(75) Inventors: Matthew E. Zacherle, Richmond, VA (US); Caleb S. Loftin, Richmond, VA (US); Aaron L. Bates, Moseley, VA (US)

(73) Assignee: MeadWestvaco Corporation, Richmond, VA (US)

( * ) Notice: Subject to any disclaimer, the term of this patent is extended or adjusted under 35 U.S.C. 154(b) by 32 days.

(21) Appl. No.: 13/404,171

(22) Filed: Feb. 24, 2012

(65) Prior Publication Data

US 2013/0221017 A1 Aug. 29, 2013

(51) Int. Cl.

| | |
|---|---|
| ***B65G 59/06*** | (2006.01) |
| ***B65D 5/54*** | (2006.01) |
| ***B65D 17/28*** | (2006.01) |
| ***B65D 83/00*** | (2006.01) |

(52) U.S. Cl.
USPC ..... 221/32; 221/30; 221/31; 229/204

(58) Field of Classification Search
USPC ..... 221/25–26, 30–32, 50, 302; 229/204
See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,383,318 | A | 7/1921 | McCormick |
| 1,393,964 | A | 10/1921 | Potts et al. |
| 1,753,957 | A | 4/1930 | Washburn |
| 1,824,937 | A | 9/1931 | Trouth |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |
| 1,985,739 | A | 12/1934 | Murray |
| 2,078,599 | A | 4/1937 | McCauley |
| 2,110,194 | A | 3/1938 | Blier |
| 2,263,353 | A | 11/1941 | Eidam |
| 2,291,187 | A | 7/1942 | Johnson |
| 2,382,191 | A | 7/1944 | Weichselbaum |
| 2,536,421 | A | 2/1951 | Burhans |
| 2,573,381 | A | 10/1951 | Arnold |
| 2,574,087 | A | 11/1951 | Burhans |

(Continued)

FOREIGN PATENT DOCUMENTS

| | | |
|---|---|---|
| GB | 2190906 | 12/1978 |
| GB | 2303624 | 2/1997 |

(Continued)

OTHER PUBLICATIONS

International Search Report and Written Opinion issued in PCT/US2010/057020 (Mar. 8, 2011).

(Continued)

*Primary Examiner* — Michael K Collins
(74) *Attorney, Agent, or Firm* — MeadWestvaco Intellectual Property Group

(57) ABSTRACT

A product dispensing system including a container having a plurality of walls that define an internal volume and an opening into the internal volume, wherein the container defines a first arrangement of perforations extending in a first row from the opening and a second arrangement of perforations extending in a second row from the opening, wherein the first perforations are staggered by a distance relative to the second perforations.

19 Claims, 10 Drawing Sheets

(56) References Cited

U.S. PATENT DOCUMENTS

| | | | | |
|---|---|---|---|---|
| 2,595,122 | A | 4/1952 | Burhans | |
| 2,784,871 | A | 3/1957 | Gabrielsen | |
| 2,795,845 | A | 6/1957 | Shimer | |
| 2,818,978 | A | 1/1958 | Post | |
| 2,826,471 | A | 3/1958 | Fonda | |
| 2,831,591 | A | 4/1958 | Morton | |
| 2,888,145 | A | 5/1959 | Knott et al. | |
| 2,915,932 | A | 12/1959 | Gross | |
| 2,919,488 | A | 1/1960 | Brownlee | |
| 2,996,344 | A | 8/1961 | Garman | |
| 3,018,149 | A | 1/1962 | Parker | |
| 3,055,293 | A | 9/1962 | Lariccia | |
| 3,066,827 | A | 12/1962 | Pryor | |
| 3,137,068 | A | 6/1964 | Quigley | |
| D198,888 | S | 8/1964 | Heselov | |
| 3,178,242 | A * | 4/1965 | Ellis et al. | 312/45 |
| 3,184,104 | A | 5/1965 | De Domenico et al. | |
| 3,203,554 | A | 8/1965 | Pendergrast et al. | |
| 3,204,335 | A | 9/1965 | Hughes | |
| 3,288,544 | A | 11/1966 | Knecht | |
| 3,300,115 | A | 1/1967 | Schauer | |
| 3,304,141 | A | 2/1967 | Rogers | |
| 3,318,455 | A | 5/1967 | Takahashi | |
| 3,335,940 | A | 8/1967 | Dykes | |
| 3,340,790 | A | 9/1967 | Simjian | |
| 3,348,738 | A | 10/1967 | Hertlein | |
| 3,392,901 | A | 7/1968 | Krzyzanowski | |
| 3,393,808 | A | 7/1968 | Chirchill | |
| 3,501,016 | A | 3/1970 | Eaton | |
| 3,763,557 | A | 10/1973 | Sewell | |
| 3,784,022 | A | 1/1974 | Beesley, Jr. | |
| 3,922,778 | A | 12/1975 | Aalpoel | |
| 3,923,159 | A | 12/1975 | Taylor et al. | |
| 3,972,454 | A | 8/1976 | Croley | |
| 4,105,126 | A | 8/1978 | Deffner et al. | |
| 4,205,440 | A | 6/1980 | Morgan | |
| 4,260,072 | A | 4/1981 | Quasarano | |
| 4,382,526 | A | 5/1983 | Stone | |
| 4,396,143 | A * | 8/1983 | Killy | 221/305 |
| 4,435,026 | A | 3/1984 | Johnson | |
| 4,467,524 | A | 8/1984 | Ruff et al. | |
| 4,511,043 | A * | 4/1985 | Roccaforte | 229/237 |
| 4,576,272 | A | 3/1986 | Morgan, Jr. | |
| 4,598,828 | A | 7/1986 | Young et al. | |
| 4,729,480 | A | 3/1988 | Groover et al. | |
| 4,744,489 | A | 5/1988 | Binder et al. | |
| 4,834,263 | A | 5/1989 | Becze | |
| 4,869,395 | A | 9/1989 | Rubbmark | |
| 4,911,309 | A | 3/1990 | Stefan | |
| 4,915,571 | A | 4/1990 | Toshihiko et al. | |
| 4,923,070 | A | 5/1990 | Jackle et al. | |
| 4,997,106 | A | 3/1991 | Rockola | |
| 4,998,628 | A | 3/1991 | Ross | |
| 5,033,348 | A | 7/1991 | Walsh | |
| 5,080,256 | A | 1/1992 | Rockola | |
| 5,097,958 | A * | 3/1992 | Josephs et al. | 229/227 |
| 5,101,703 | A | 4/1992 | Tanaka et al. | |
| 5,167,345 | A | 12/1992 | Bleeker | |
| 5,251,972 | A | 10/1993 | Zurawin | |
| 5,289,943 | A | 3/1994 | Powell | |
| 5,314,078 | A | 5/1994 | Morikiyo et al. | |
| 5,328,258 | A | 7/1994 | Scalise | |
| 5,356,033 | A | 10/1994 | Delaney | |
| 5,372,278 | A | 12/1994 | Leight | |
| 5,390,821 | A | 2/1995 | Markel | |
| 5,396,997 | A | 3/1995 | Johnson | |
| D363,174 | S | 10/1995 | Fletcher, Sr. | |
| 5,462,198 | A | 10/1995 | Schwimmer | |
| 5,529,207 | A | 6/1996 | Oden et al. | |
| 5,598,920 | A * | 2/1997 | Hansen | 206/148 |
| 5,638,988 | A | 6/1997 | Rogers | |
| 5,685,664 | A | 11/1997 | Parham et al. | |
| 5,740,610 | A | 4/1998 | Ayer et al. | |
| 5,788,117 | A | 8/1998 | Zimmanck | |
| 5,791,048 | A | 8/1998 | Bodnar et al. | |
| 5,836,478 | A | 11/1998 | Weiss | |
| 5,878,862 | A | 3/1999 | Dewsnap | |
| 5,894,942 | A | 4/1999 | Miyashita et al. | |
| 5,992,286 | A | 11/1999 | Boole | |
| 5,992,652 | A | 11/1999 | Springs | |
| 6,186,345 | B1 | 2/2001 | Robertson | |
| 6,199,720 | B1 | 3/2001 | Rudick et al. | |
| 6,206,237 | B1 | 3/2001 | Dillon et al. | |
| 6,253,930 | B1 | 7/2001 | Freidus et al. | |
| 6,267,258 | B1 | 7/2001 | Wilkerson et al. | |
| 6,393,799 | B2 | 5/2002 | Jenkins et al. | |
| 6,453,641 | B1 | 9/2002 | Puckett | |
| 6,637,604 | B1 | 10/2003 | Jay | |
| 6,802,433 | B2 | 10/2004 | Leykin | |
| 6,991,116 | B2 * | 1/2006 | Johnson et al. | 211/59.2 |
| 7,163,139 | B2 * | 1/2007 | Marie et al. | 229/237 |
| 7,207,447 | B2 | 4/2007 | Medcalf et al. | |
| 7,303,095 | B2 | 12/2007 | Nagelski et al. | |
| 7,445,114 | B2 * | 11/2008 | Olsen | 206/150 |
| 7,546,973 | B2 | 6/2009 | Budz et al. | |
| 7,584,854 | B2 | 9/2009 | Chandaria | |
| D604,972 | S | 12/2009 | Henry et al. | |
| 7,648,060 | B2 * | 1/2010 | DeBusk | 229/122 |
| 7,665,618 | B2 | 2/2010 | Jay et al. | |
| 7,673,789 | B2 * | 3/2010 | DeBusk et al. | 229/242 |
| 7,681,745 | B2 | 3/2010 | Richter | |
| 7,810,672 | B1 | 10/2010 | Mason et al. | |
| 7,823,733 | B2 | 11/2010 | Futori | |
| 7,850,015 | B1 | 12/2010 | Mason | |
| 7,913,860 | B2 | 3/2011 | Merl | |
| 7,918,365 | B2 | 4/2011 | White et al. | |
| 7,922,437 | B1 * | 4/2011 | Loftin et al. | 414/412 |
| 7,938,312 | B2 * | 5/2011 | Ford | 229/117.3 |
| 7,992,747 | B2 | 8/2011 | Bauer | |
| 8,028,855 | B2 | 10/2011 | White et al. | |
| 8,302,809 | B1 * | 11/2012 | Bogdziewicz et al. | 221/31 |
| 8,308,023 | B2 * | 11/2012 | Gelardi et al. | 221/31 |
| 8,322,543 | B2 * | 12/2012 | Gelardi et al. | 211/59.2 |
| 2002/0043509 | A1 | 4/2002 | Lajeunesse et al. | |
| 2004/0011751 | A1 | 1/2004 | Johnson et al. | |
| 2004/0262326 | A1 | 12/2004 | Christensen | |
| 2005/0127015 | A1 | 6/2005 | Medcalf et al. | |
| 2005/0207877 | A1 | 9/2005 | Haverdink | |
| 2006/0081692 | A1 | 4/2006 | Stewart et al. | |
| 2006/0237384 | A1 | 10/2006 | Neumann et al. | |
| 2006/0278591 | A1 | 12/2006 | Tippets et al. | |
| 2008/0245813 | A1 | 10/2008 | Johnson et al. | |
| 2009/0212066 | A1 | 8/2009 | Bauer | |
| 2009/0266776 | A1 | 10/2009 | Johnson | |
| 2010/0032391 | A1 | 2/2010 | Schneider et al. | |
| 2011/0121010 | A1 | 5/2011 | Loftin et al. | |
| 2011/0121011 | A1 * | 5/2011 | Gelardi et al. | 221/30 |

FOREIGN PATENT DOCUMENTS

| | | | |
|---|---|---|---|
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | A | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |

(56) References Cited

FOREIGN PATENT DOCUMENTS

| | | | |
|---|---|---|---|
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO-9106076 | A1 | 5/1991 |
| WO | WO 2004113808 | | 12/2004 |
| WO | WO 2009138538 | | 11/2009 |

OTHER PUBLICATIONS

International Search Report and Written Opinion issued in PCT/US2010/057221 (Mar. 4, 2011).

International Search Report and Written Opinion, PCT/US2013/025261 (2013).

* cited by examiner

PRODUCT DISPENSING SYSTEM WITH STAGGERED PERFORATIONS

FIELD

This application relates to the dispensing of products from packaging containers and, more particularly, to product dispensers configured to cooperate with packaging containers to dispense products.

BACKGROUND

Products are typically shipped to retailers in bulk by enclosing multiple individual product units in a container, such as a carton or box. For example, canned foods may be shipped to a retailer in a box containing a number of individual cans. Then, it is typically the retailer's obligation to remove the individual product units from the container and present them to consumers.

Alternatives to the traditional package-ship-unpack-display model are being developed in an effort to improve operating efficiency. For example, U.S. Pat. No. 7,922,437 to Loftin et al. discloses a new system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that products roll from the container and down to the product display area of the frame under the force of gravity.

As another example, U.S. patent application Ser. No. 13/032,734 filed by Gelardi et al. discloses a product dispensing system that utilizes an opening tool having a catch element that engages and opens a container as the container is loaded onto the dispenser, and then guides the container to avoid interference between the dispensing products and the open container.

Despite advances already made in the field, those skilled in the art continue with research and development efforts directed to apparatus and systems for dispensing products from packaging containers.

SUMMARY

In one aspect, the disclosed product dispensing system may include a container having a plurality of walls that define an internal volume and an opening into the internal volume, wherein the container defines a first arrangement of perforations extending in a first row from the opening and a second arrangement of perforations extending in a second row from the opening, wherein the first perforations are staggered by a distance relative to the second perforations.

In another aspect, the disclosed product dispensing system may include a container having a plurality of walls that define an internal volume and an opening into the internal volume, wherein the container defines a first arrangement of perforations extending in a first row from the opening and a second arrangement of perforations extending in a second row from the opening, the first row being generally parallel with the second row, wherein each perforation of the first row is staggered by at least 0.5 millimeters relative to a corresponding perforation of the second row.

In yet another aspect, disclosed is a method for dispensing products. The method may include the steps of (1) providing a container comprising a plurality of walls that define an internal volume and an opening into the internal volume, wherein the container defines a plurality of first perforations arranged in a first row extending from the opening and a plurality of second perforations arranged in a second row extending from the opening, wherein the plurality of first perforations are staggered by a distance relative to the plurality of second perforations, wherein a plurality of products are initially received in the internal volume; (2) providing a dispenser including a frame defining a frame opening, and further configured to support the container, and a catch element connected to the frame, the catch element being positioned to extend through the first opening when the container is loaded onto the frame; (3) urging the container along the frame such that the catch element extends through the opening and tears the first perforations in the first row and the second perforations in the second row to form an access opening in the container; and (4) aligning the access opening with the frame opening such that at least one product moves from the container to the dispenser.

Other aspects of the disclosed product dispensing system with staggered perforations will become apparent from the following detailed description, the accompanying drawings and the appended claims.

DETAILED DESCRIPTION

Figure 1:
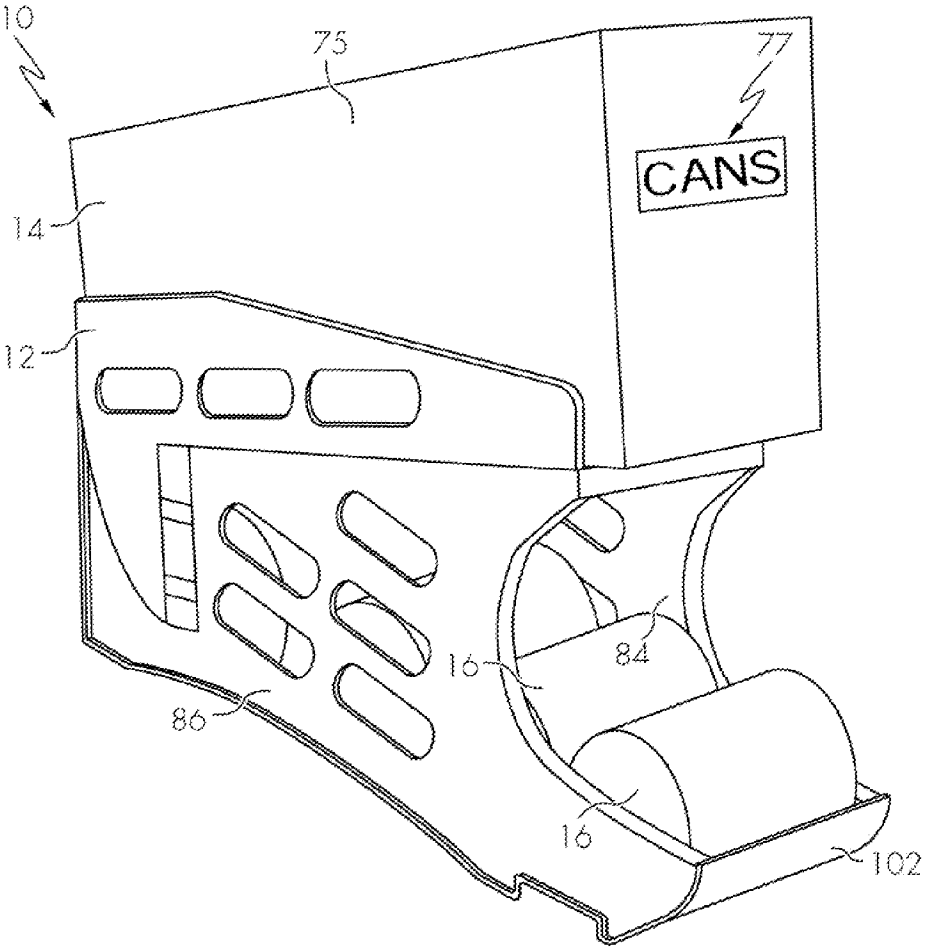
FIG. 1 is a front and side perspective view of one aspect of the disclosed product dispensing system.

Referring to FIG. 1, one aspect of the disclosed product dispensing system, generally designated 10, may include a dispenser 12 and a container 14. The container 14 may house multiple units of product 16. The container 14 may be loaded onto the dispenser 12 by urging the container 14 generally horizontally along the dispenser 12. As the container 14 is urged along the dispenser 12, the dispenser 12 may engage and open the container 14, thereby releasing the products 16 from the container 14 to the dispenser 12.

The container 14 may be any container capable of housing products 16 and beneficially interacting with the disclosed dispenser 12. For example, the container 14 may be a paperboard carton or a corrugated box.

Figure 2A:
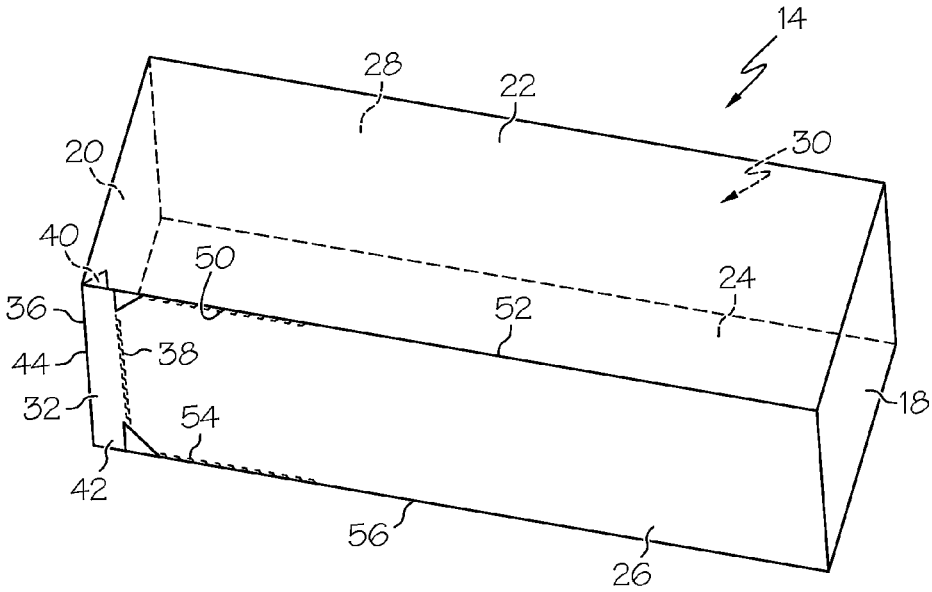
FIG. 2A is a bottom and side perspective view of the container of the product dispensing system of FIG. 1.
Figure 7:
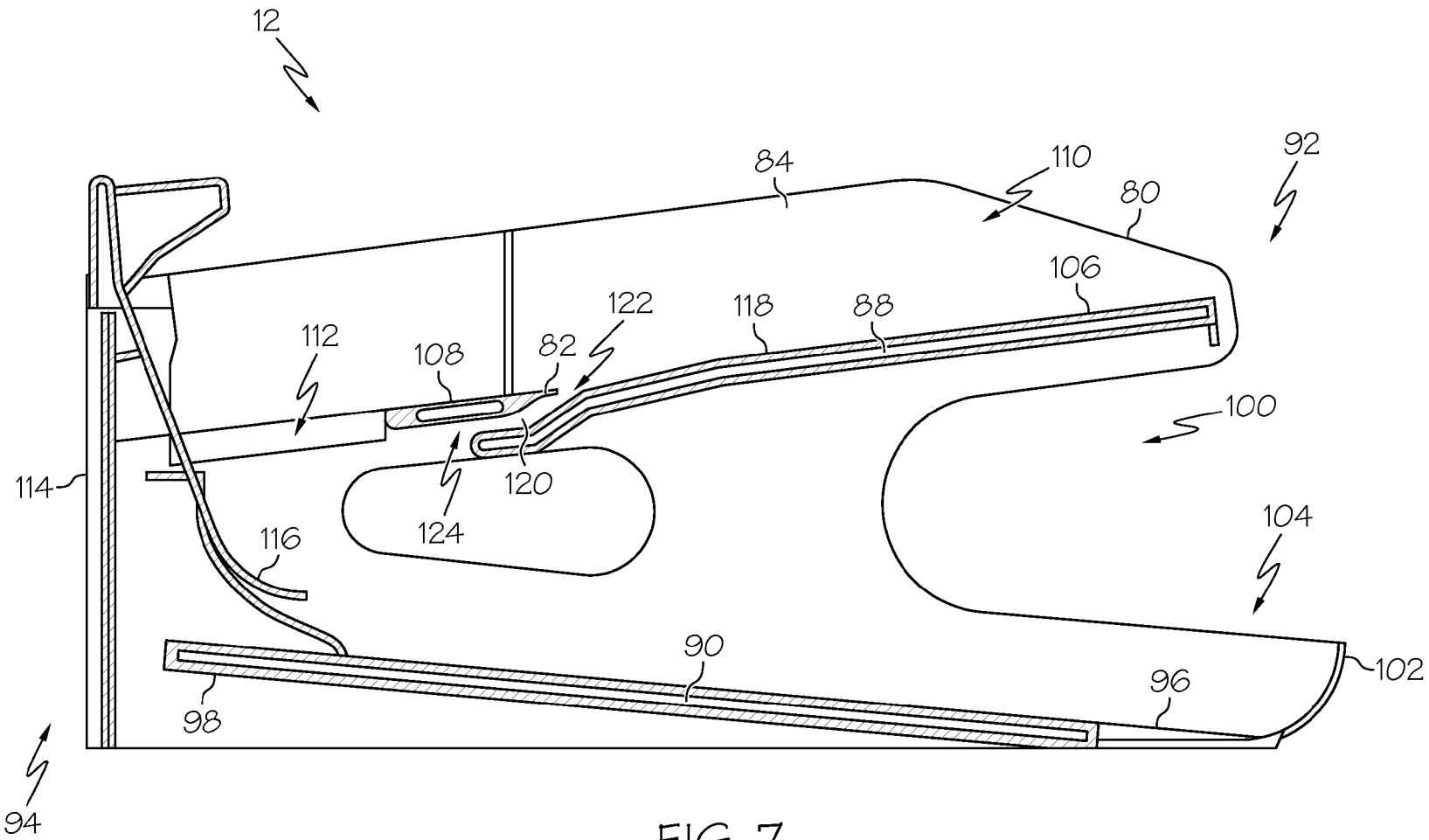
FIG. 7 is a side elevational view, in section, of the dispenser of the product dispensing system of FIG. 1.
Figure 8:
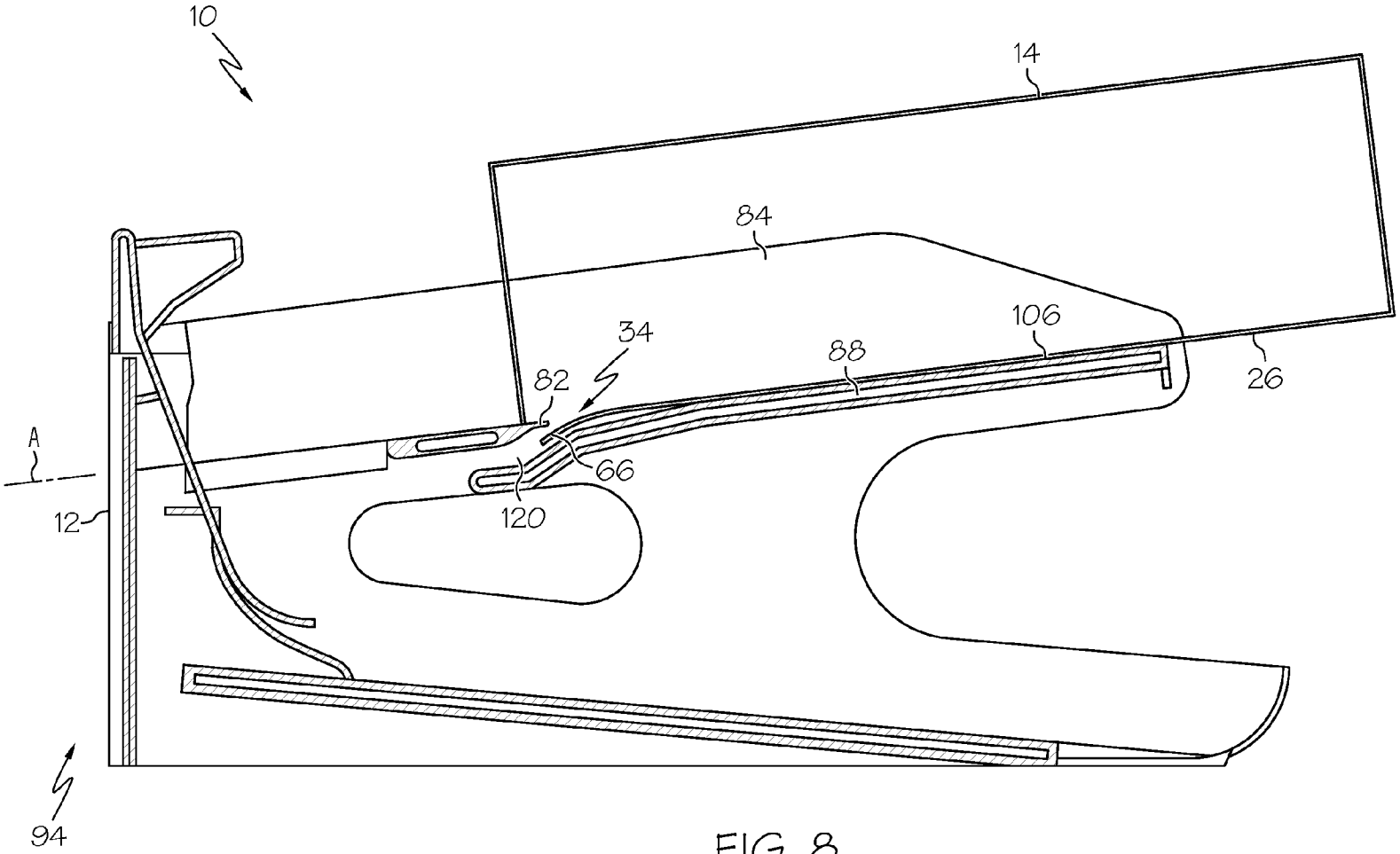
FIG. 8 is a side elevational view, in section, of the dispenser of FIG. 6, shown with the container in a first, partially loaded configuration.

Referring to FIG. 2A, the container 14 may be a generally rectilinear container having six walls 18, 20, 22, 24, 26, 28 that define an internal volume 30 for receiving the products 16 (FIGS. 7 and 8). Opposed walls 18 and 20 may define the front and rear walls, respectively, of the container 14. Opposed walls 22 and 24 may define the first (e.g., left) and second (e.g., right) side walls, respectively, of the container 14. Opposed walls 26 and 28 may define the base and upper walls, respectively, of the container 14.

Figure 2B:
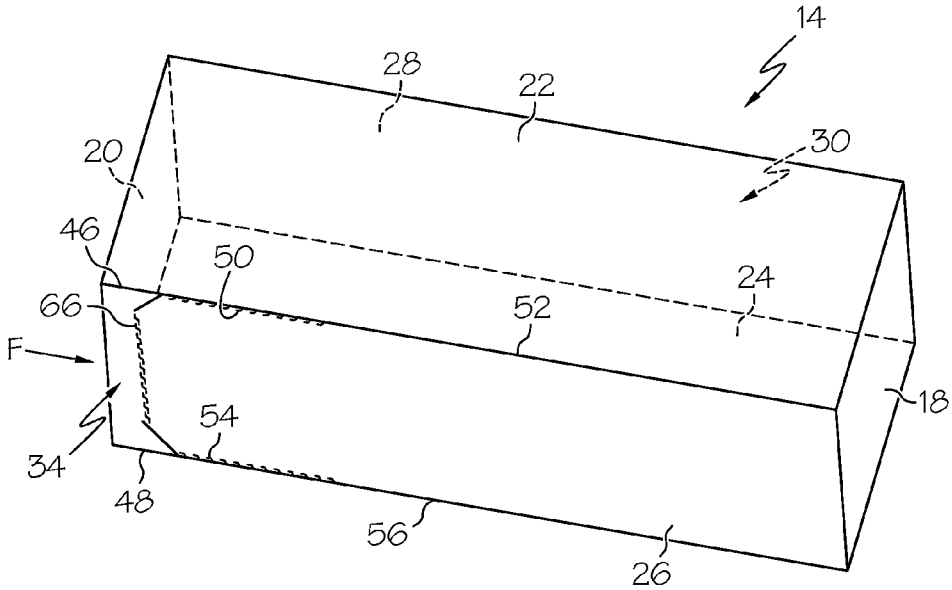
FIG. 2B is a bottom and side perspective view of the container of FIG. 2A, shown with an initiation opening formed therein.

In a first construction, the base wall 26 of the container 14 may include a removable priming feature 32, as shown in FIG. 2A. As shown in FIG. 2B, the removable priming feature 32 may be removed from the container 14 to reveal an initiation opening 34 that opens into the internal volume 30 of the container 14. The removable priming feature 32 may be positioned such that the initiation opening 34 is formed proximate (i.e., at or near) the rear wall 20 of the container 14, such as along the edge 44 between the base wall 26 and the rear wall 20.

Referring to FIG. 2A, the removable priming feature 32 may be a zipper strip or the like, and may be defined by two parallel, laterally extending rows of perforations or cuts 36, 38 and two parallel, longitudinally extending rows of perforations or cuts 40, 42. Weakening features other than perforations and cuts may also be used.

Thus, prior to loading the container 14 onto the dispenser 12, a user may remove the removable priming feature 32 from the container 14, such as by tearing the removable priming feature 32 from the container 14 along the rows of cuts 36, 38, 40, 42, thereby forming the initiation opening 34, as shown in FIG. 2B.

In a second construction, the initiation opening 34 may be pre-formed in the base wall 26 of the container 14. Optionally, a peelable label or the like (not shown) may be applied to the container 14 over the pre-formed initiation opening 34. Therefore, the initiation opening 34 may be revealed by peeling away the optional peelable label from the container 14.

Referring to FIG. 2B, the initiation opening 34 may extend generally laterally between the side walls 22, 24 of the container 14. For example, the initiation opening 34 may include a first (e.g., left) end 46 positioned proximate the left side wall 22 of the container 14 and a second (e.g., right) end 48 positioned proximate the right side wall 24 of the container 14.

Those skilled in the art will appreciate that the initiation opening 34 may be positioned at various alternative locations and may have various alternative configurations, provided that the initiation opening 34 is capable of being engaged by the dispenser 12 when the container 14 is being loaded onto the dispenser 12. As a first alternative implementation, the initiation opening 34 may be formed in the rear wall 20 of the container 14. As a second alternative implementation, the initiation opening 34 may be formed in the base wall 26, between the front 18 and rear 20 walls of the container 14. Other implementations are also contemplated.

A first weakening feature 50 may generally longitudinally extend from the initiation opening 34 toward the front wall 18 of the container 14. The first weakening feature 50 may be formed in the base wall 26 proximate the edge 52 between the base wall 26 and the left side wall 22.

A second weakening feature 54 may generally longitudinally extend from the initiation opening 34 toward the front wall 18 of the container 14, and may be laterally spaced from the first weakening feature 50. The second weakening feature 54 may be formed in the base wall 26 proximate the edge 56 between the base wall 26 and the right side wall 24.

The longitudinal length of the first and second weakening features 50, 54 may be dictated by the size (e.g., the diameter) of the products 16 housed in the container 14. As one example, the first and second weakening features 50, 54 may extend along at least 5 percent of the length of the edge 52. As another example, the first and second weakening features 50, 54 may extend along at least 10 percent of the length of the edge 52. As another example, the first and second weakening features 50, 54 may extend along at least 20 percent of the length of the edge 52. As yet another example, the first and second weakening features 50, 54 may extend along at least 30 percent of the length of the edge 52.

Figure 3:
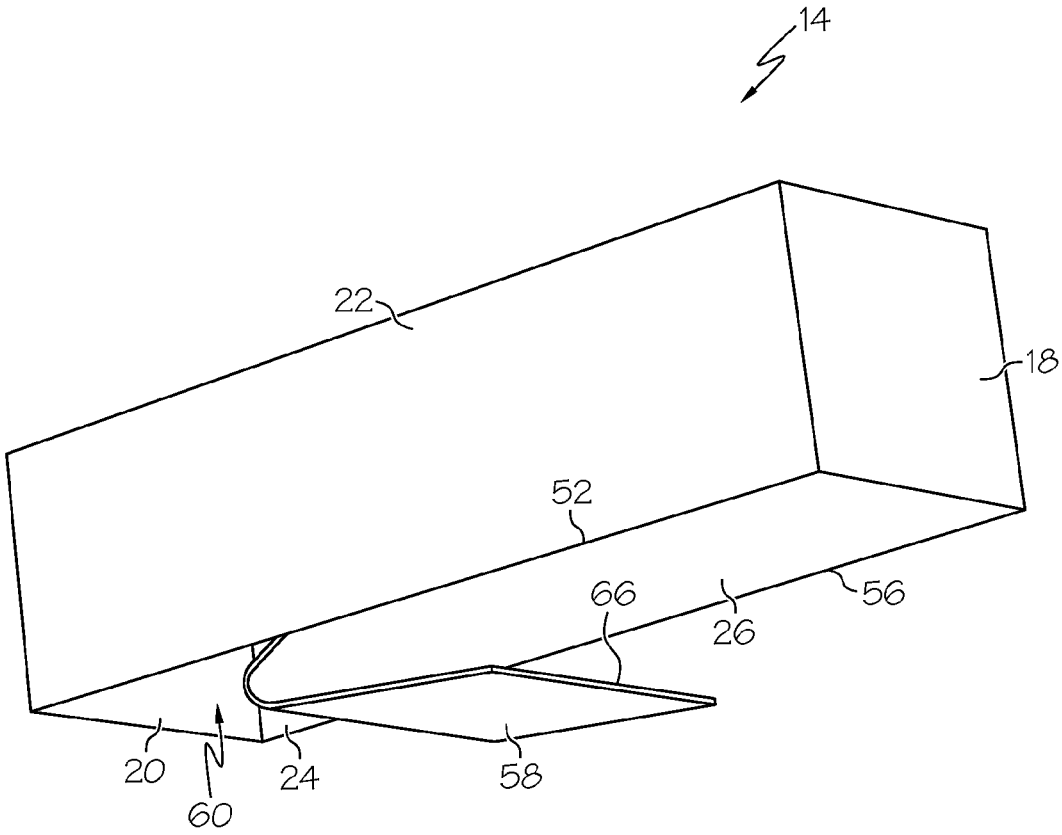
FIG. 3 is a side and bottom perspective view of the container of FIG. 2B, shown in an opened configuration.

The first and second weakening features 50, 54 may facilitate the separation of a portion of the base wall 26 from the rest of the container 14, as shown in FIG. 3. In a first implementation, the first and second weakening features 50, 54 may be formed as rows of perforations. As used herein, "perforation" broadly refers to any structure (or absence of structure) that may be used to form the first and second weakening features 50, 54, and includes traditional, generally circular (in plan view) perforations, as well as elongated punctures or cuts. For example, the first and second weakening features 50, 54 may be formed as rows of standard perforations, as rows of micro perforations or as rows of cuts, such as zipper-like cuts. Other techniques useful for forming the first and second weakening features 50, 54 will become apparent to those skilled in the art.

Figure 5:
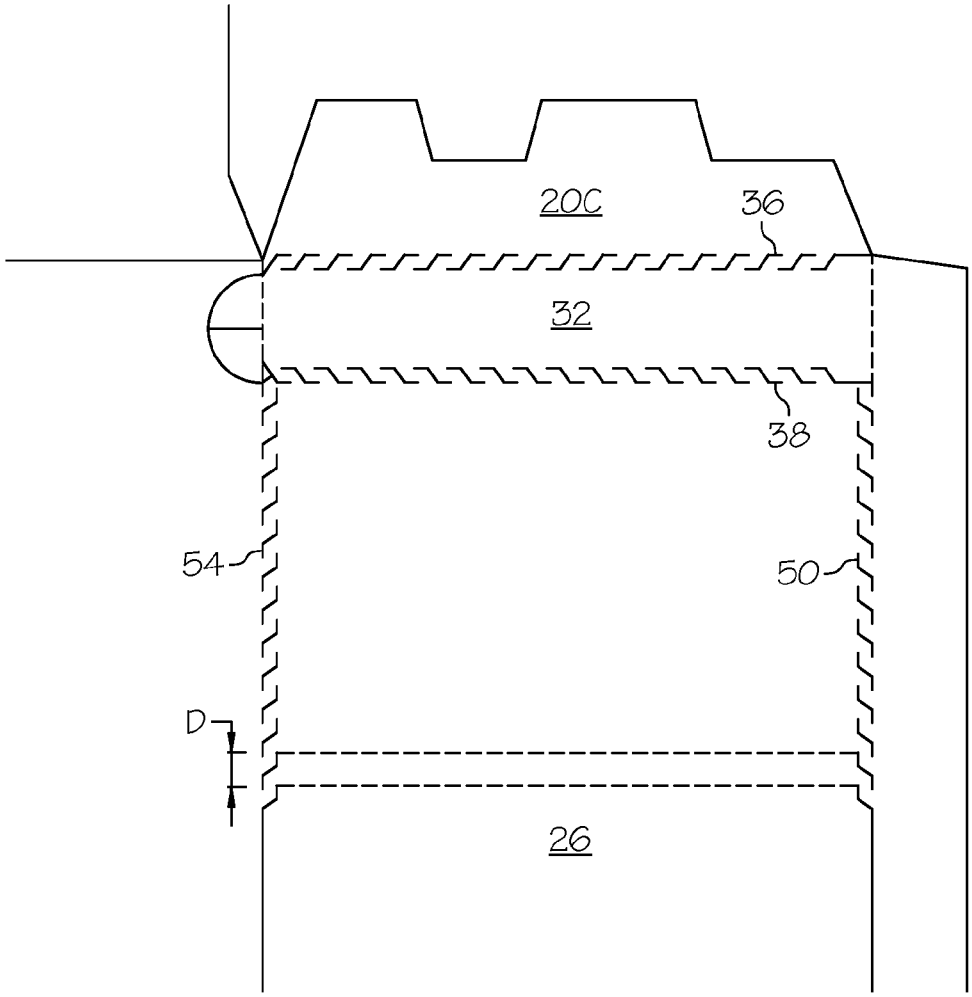
FIG. 5 is a detailed top plan view of a portion of the container blank of FIG. 4.

As shown in FIG. 5, the first and second weakening features 50, 54 may contain rows of generally aligned perforations that may be staggered by a distance D. The distance D may be greater than or equal to 0.5 mm, greater than or equal to 1 mm, greater than or equal to 1.5 mm, greater than or equal to 2 mm, or greater than or equal to 3 mm.

Accordingly, the perforations in the first weakening feature 50 are offset in relation to the perforations in the second weakening feature 54.

Figure 6:
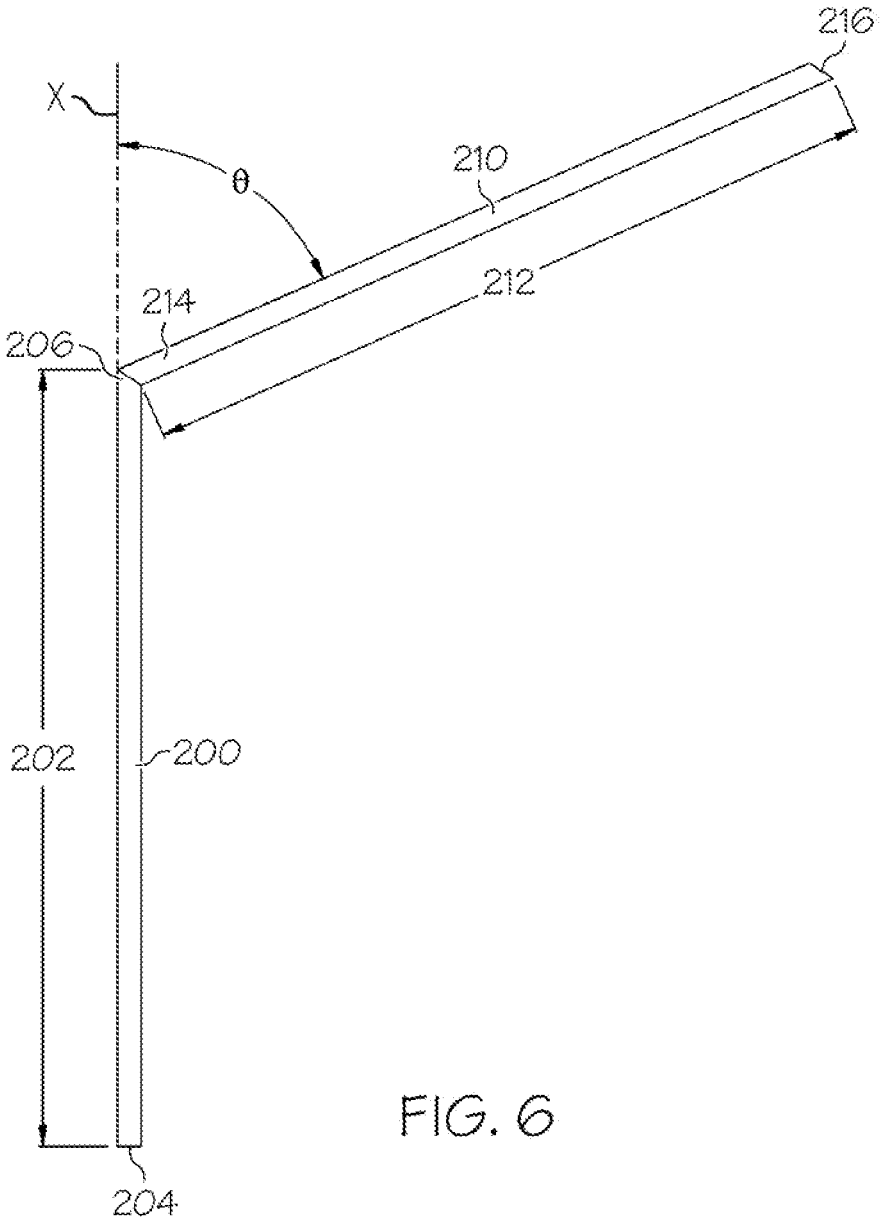
FIG. 6 is a detailed top plan view of one cut of the weakening features shown in FIG. 5.

In one particular construction, the perforations in the first and second weakening features 50, 54 may be formed cuts. The cuts may be generally longitudinally extending cuts, as shown in greater detail in FIG. 6. Each cut may further include a longitudinal portion 200 and an angled portion 210.

The longitudinal portion 200 may have a length 202, a first end 204, and a second end 206. The length 202 may be defined by the distance between the first end 204 and the second end 206. The length 202 may further be any suitable length of a typical zipper-like cut. Optionally, the length 202 may closely correspond to (e.g., be equal to) the staggered distance D (FIG. 5). As an example, the length 202 may be greater than or equal to 0.5 mm, greater than or equal to 1 mm, greater than or equal to 1.5 mm, greater than or equal to 2 mm, or greater than or equal to 3 mm.

The angled portion 210 may have a length 212, a first end 214, and a second end 216. The length 212 may be defined by the distance between the first end 214 and the second end 216. The length 212 may further be any suitable length of a typical perforation or cut in accordance with the present disclosure. As an example, the length 212 may be greater than or equal to 0.5 mm, greater than or equal to 1 mm, greater than or equal to 1.5 mm, greater than or equal to 2 mm, or greater than or equal to 3 mm.

The angled portion 210 may extend inward from the second end 206 of the longitudinal portion 200 at a non-zero angle θ relative to the longitudinal axis X of the longitudinal portion 200. The angle θ may be any suitable angle of a typical perforation or cut in accordance with the present disclosure. As an example, the angle θ may be greater than or equal to 20 degrees, greater than or equal to 30 degrees, greater than or equal to 40 degrees, or greater than or equal to 45 degrees.

Referring back to FIG. 5, the staggered distance D may be measured from the second end 216 of the angled portion 210 of a perforation in the first weakening feature 50 to the second end 216 of the angled portion 210 of a corresponding perforation of the second weakening feature 54.

A force F (FIG. 2B) applied to the base wall 26 at the initiation opening 34 may partially separate a portion of the base wall 26 from the container 14 along the first and second weakening features 50, 54 to form an access panel 58, as shown in FIG. 3. As the access panel 58 is separated from the remainder of the container 14, the size of the initiation opening 34 may be significantly increased, thereby forming an access opening 60 in the container 14. The access opening 60 may allow the products 16 housed in the container 14 to be dispensed from the container 14 and, ultimately, into the dispenser 12 when the container 14 is loaded on the dispenser 12.

If the perforations within weakening features 50, 54 were not staggered, the force F (FIG. 2B) applied to the base wall 26 at the initiation opening 34 would be evenly distributed between each corresponding perforation on the first and second weakening features 50, 54. This even distribution of the force F results in less force directed towards each perforation or cut, and may often result in a need for additional force to break the perforations, which may be difficult for some users.

With the staggered perforations or cuts as described herein, the force F is only applied to a perforation on one of the weakening features 50, 54 at a time (or at least until a tear is initiated). As force F is applied to the base wall 26, the force is directed in an alternating manner between perforations in the first weakening feature 50 and the second weakening feature 54. As force is applied to one perforation, no force is applied on the other until the first perforation breaks (or at least a tear is initiated in the first perforation). Then, the force advances to the next perforation on the other weakening feature. Accordingly, less force is necessary to break the perforations, which may prove easier for some users.

Figure 4:
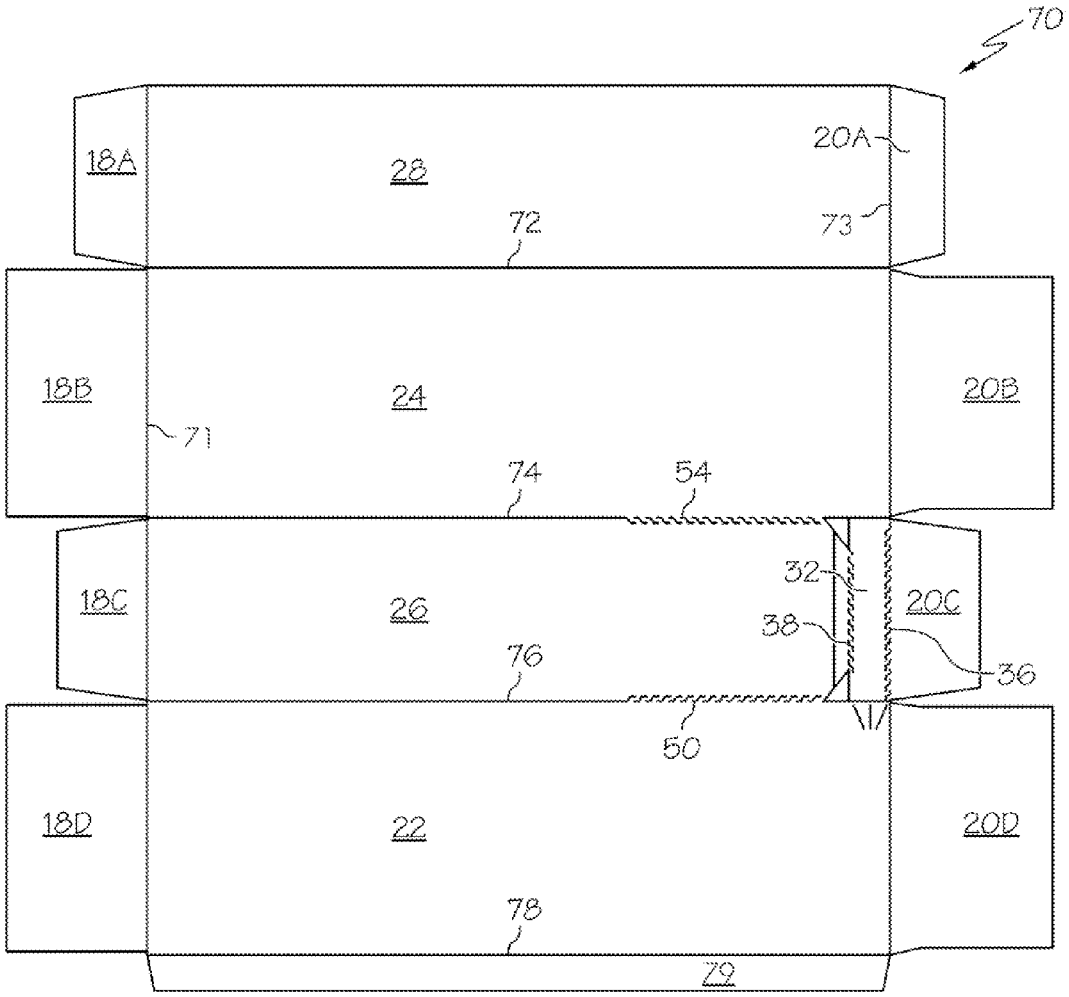
FIG. 4 is a top plan view of a container blank that may be used to form the container of FIG. 2A.

The container 14 may be formed from a paperboard container blank, such as the paperboard container blank 70 shown in FIG. 4. The container blank 70 may include a plurality of pre-formed fold lines 72, 74, 76, 78, 71, 73 that define the front wall 18 (comprised of front wall panels 18A, 18B, 18C and 18D), the rear wall 20 (comprised of rear wall panels 20A, 20B, 20C and 20D), the right side wall 24, the left side wall 22, the base wall 26, the upper wall 28 and sealing panel 79.

The container 14 may be assembled by folding the container blank 70 along the longitudinal fold lines 72, 74, 76, 78 and connecting the upper wall 28 to the sealing panel 79 to form the three-dimensional body of the container 14. Then, the front wall panels 18A, 18B, 18C, 18D may be assembled to form the front wall 18 of the container 14. Finally, the rear wall panels 20A, 20B, 20D, 20D may be assembled to form the rear wall 20 of the container 14.

The container blank 70 may be formed from a paperboard-based material, such as C1S paperboard, which may have a coating (e.g., clay) on a first major surface thereof, which may form the outer surface 75 (FIG. 1) of the container 14, and an uncoated second major surface. As another example, the paperboard-based material may be C2S paperboard, which may have a coating (e.g., clay) on both major surfaces thereof. Optionally, at least one major surface of the container blank may be marked with various indicia 77 (FIG. 1), such as printed text and/or graphics.

While a specific paperboard container blank 70 is shown and described, those skilled in the art will appreciate that various techniques and materials may be used to form the container 14. Folded paperboard containers are only one specific and non-limiting example of the disclosed container 14.

Various products 16 having various shapes and configurations may be housed in the container 14 and dispensed by the disclosed product dispensing system 10. Suitable products 16 include cans (e.g., canned soup or pet food), jars (e.g., jarred sauce) or bottles (e.g., bottled soft drinks).

Figure 9:
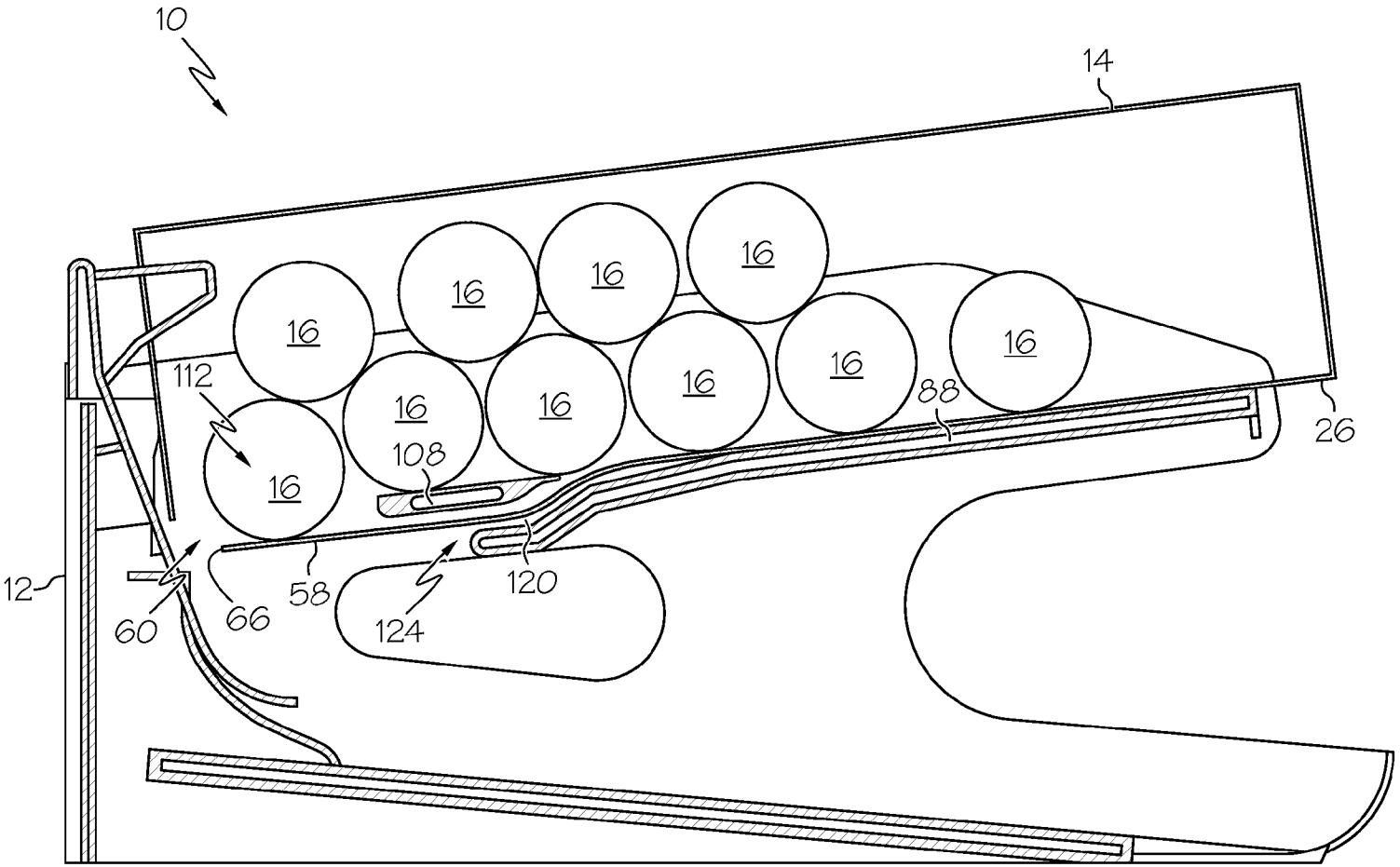
FIG. 9 is a side elevational view, in section, of the dispenser of FIG. 7, shown with the container in a second, fully loaded configuration.
Figure 10:
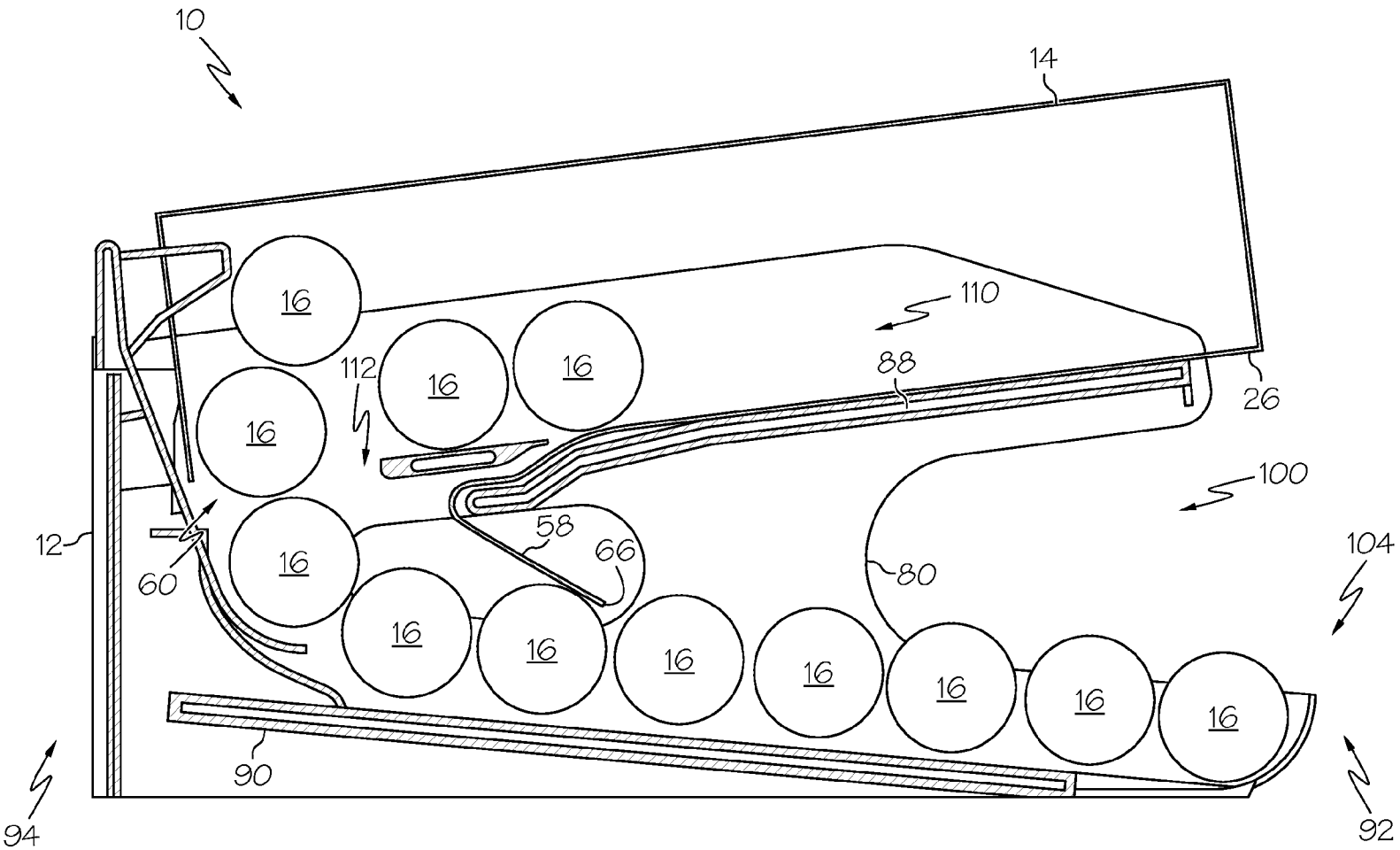
FIG. 10 is a side elevational view, in section, of the dispenser of FIG. 8, shown with the container in a third, dispensing configuration.

Referring to FIG. 7, the dispenser 12 may include a frame 80 and a catch element 82. The frame 80 of the dispenser 12 may support the container 14 in a desired configuration, such as a slightly declined, but generally horizontal configuration, as shown in FIGS. 1, 9 and 10. As the container 14 is generally horizontally urged along the dispenser 12 to the configuration shown in FIGS. 1, 9 and 10, the catch element 82 may engage the initiation opening 34 (FIG. 2B) in the container 14 to separate the access panel 58 (FIG. 3) from the container 14, as is described in greater detail herein.

The frame 80 may include a first (e.g., right) side wall 84, a second (e.g., left) side wall 86, an upper support deck 88 and a lower support deck 90. The right side wall 84 may be laterally spaced from the left side wall 86, and may be generally parallel with the left side wall 86. The frame 80 may include a first (e.g., front) end 92 and a second (e.g., rear) end 94 longitudinally opposed from the first end 92.

The lower support deck 90 may laterally extend between the right 84 and left 86 side walls, and may include a front end 96 that longitudinally extends toward the front end 92 of the frame 80 and a rear end 98 that longitudinally extends toward the rear end 94 of the frame 80. Therefore, the lower support deck 90 and the side walls 84, 86 may define a lower level 100 of the frame 80.

The lower support deck 90 may be inclined from the front end 96 to the rear end 98 (i.e., the rear end 98 may be elevated relative to the front end 96) such that products 16 deposited proximate the rear end 98 of the lower support deck 90 roll down to the front end 96 of the lower support deck 90 under the force of gravity. The extent of the incline of the lower support deck 90 may be dictated by, among other things, the coefficient of friction of the material used to form the frame 80 and the shape of the products 16 to be dispensed by the dispenser 12.

A stop 102 may be positioned proximate the front end 96 of the lower support deck 90 to prevent products 16 from rolling beyond the front end 96 of the lower support deck 90. For example, the stop 102 may be connected to (e.g., integral with) the lower support deck 90, and may form an upward curve at the front end 96 of the lower support deck 90. Therefore, the stop 102 may collect products 16 at the front end 96 of the lower support deck 90, thereby defining a product display area 104 at the front end 96 of the lower support deck 90.

The upper support deck 88 may laterally extend between the right 84 and left 86 side walls, and may include a front end 106 that longitudinally extends toward the front end 92 of the frame 80 and a rear end 108 that longitudinally extends toward, but not to, the rear end 94 of the frame 80. Therefore, the upper support deck 88 and the side walls 84, 86 may define an upper level 110 of the frame 80.

The spacing between the rear end 108 of the upper support deck 88 and the rear end 94 of the frame 80 may define an opening 112, which may function as a chute to allow products 16 to move from the upper level 110 to the lower level 100 of the frame 80. When the container 14 is in the fully loaded configuration on the dispenser 12, as shown in FIGS. 8 and 9, the access opening 60 (FIG. 3) in the container 14 may be aligned with the opening 112 (FIG. 5) defined by the frame 80.

The upper support deck 88 may be declined from the front end 106 to the rear end 108 (i.e., the front end 106 may be elevated relative to the rear end 108). Therefore, products 16 supported on the upper support deck 88 may roll under the force of gravity down to the rear end 108 of the upper support deck 88, through the opening 112, to the lower level 100 of the frame 80 and, ultimately, to the product display area 104.

An optional rear wall 114 may be positioned proximate the rear end 94 of the frame 80 between the right 84 and left 86 side walls. The rear wall 114 may serve as a stop that inhibits rearward horizontal movement of the container 14 (FIG. 1) along the upper support deck 88 beyond the rear wall 114.

A guide 116 may be connected to the rear wall 114 of the frame 80, and may extend through the opening 112 in the frame 80, from the upper level 110 to the lower level 100. The guide 116 may be a ramp-like structure, and may be positioned to receive products 16 exiting the container 14 and passing through the opening 112 in the frame 80, and may guide the products 16 to the rear end 98 of the lower support deck 90.

The catch element 82 may be positioned between the front end 106 and the rear end 108 of the upper support deck 88. For example, the catch element 82 may be positioned proximate the rear end 108 of the upper support deck 88.

The catch element 82 may laterally extend between the side walls 84, 86 of the frame 80, and may longitudinally protrude toward the front end 92 of the frame 80. The specific size and shape of the catch element 82 may depend on the size and shape of the initiation opening 34 in the container 14.

In an effort to minimize interference between the catch element 82 and the container 14 during loading, the catch element 82 may be substantially co-planar with the upper surface 118 of the upper support deck 88. However, those skilled in the art will appreciate that slight displacement and/or a slight angle of the catch element 82 relative to the upper surface 118 of the upper support deck 88 may encourage engagement of the initiation opening 34 in the container 14 by the catch element 82 during loading of the container 14 onto the dispenser 12.

While the catch element 82 is shown and described as a generally flat, laterally elongated and forwardly extending protrusion, those skilled in the art will appreciate that various alternative structures may be used as the disclosed catch element 82 without departing from the scope of the present disclosure. For example, suitable catch elements may include various hooks, protrusions, flanges, detents and the like sufficient to engage the initiation opening 34 in the container 14 and separate the access panel 58 from the base wall 26 of the container 14.

The upper support deck 88 may define a channel 120 positioned to guide the access panel 58 below the upper surface 118 of the upper support deck 88 as the access panel 58 is separated from the container 14 by the catch element 82. The channel 120 may extend from an entrance opening 122 proximate the catch element 82, down below the catch element 82 and, ultimately, to an exit opening 124. The channel 120 may laterally extend between the side walls 84, 86 of the frame 80, and may have a lateral width sufficient to allow the access panel 58 (FIG. 3) to pass therethrough. Alternatively, the channel 120 may move longitudinally along the support deck 88 from the rear end 94 to the front end 92 (FIG. 10).

Thus, the catch element 82 may engage the initiation opening 34 (FIG. 2B) in the container 14 and may separate the access panel 58 (FIG. 3) from the container 14 as the container 14 is moved horizontally along the upper support deck 88 toward the rear end 94 of the frame 80. The shape and position of the catch element 82 may be configured such that a portion of the catch element 82 extends through the initiation opening 34 (FIG. 2B) in the container 14. Therefore, as the container 14 moves relative to the catch element 82, the catch element 82 may urge the base wall 26 downward through the opening 122 and into the channel 120, thereby causing separating of the access panel 58 (FIG. 3) from the container 14 along the first and second weakening features 50, 54 (FIG. 2B) and, ultimately, the formation of the access opening 60 (FIG. 3) in the container 14.

FIGS. 7-9 illustrate the container 14 being loaded onto the dispenser 12 such that the catch element 82 of the dispenser 12 engages and opens the container 14, thereby releasing the products 16 initially housed in the container 14 to the dispenser 12. Specifically, FIGS. 7-9 illustrate the container 14 being urged generally horizontally along the upper support deck 88 (i.e., along the longitudinal axis A of the upper support deck 88) toward the rear end 94 of the dispenser frame 80, thereby automatically opening the container 14 and dispensing the products 16 from the container 14 to the dispenser 12.

As shown in FIG. 7, as the initiation opening 34 in the container 14 approximates the catch element 82 of the dispenser 12, the catch element 82 may pass through the initiation opening 34. With the catch element 82 extending through the initiation opening 34, the rear edge 66 of the base wall 26 of the container 14 may be directed downward through the entrance opening 122 of the channel 120.

As shown in FIG. 8, as the container 14 continues to longitudinally move along the upper support deck 88 toward the rear end 94 of the dispenser 12, the base wall 26 of the container 14 may pass through the channel 120, thereby separating the access panel 58 from the base wall 26.

As shown in FIG. 9, with the container 14 fully loaded onto the dispenser 12, the access opening 60 formed in the container 14 may be aligned with the opening 112 between upper 110 and lower 100 levels of the frame 80. Therefore, the force of gravity may urge the products 16 initially housed in the container 14 through the access opening 60 in the container 14, through the opening 112 in the frame 80, down to the lower support deck 90 and, ultimately, to the product display area 104.

Accordingly, the use of staggered perforations as described herein may provide one or more advantageous methods of forming the access panel. Such methods may be advantageous because the perforations may be more likely than the prior art to separate when a force is provided. Additionally, such methods may be advantageous because less of a force may be necessary to separate the perforations than what was required in the past. Other advantages may also become apparent to those skilled in the art.

Although various aspects of the disclosed product dispensing system have been shown and described, modifications may occur to those skilled in the art upon reading the specification. The present application includes such modifications and is limited only by the scope of the claims.

What is claimed is:

1. A product dispensing system comprising:

a container comprising a plurality of walls that define an internal volume and an opening into said internal volume, wherein said container defines a plurality of first perforations arranged in a first row extending from said opening and a plurality of second perforations arranged in a second row extending from said opening, wherein said plurality of first perforations are staggered by a distance relative to said plurality of second perforations; and a dispenser comprising:

a frame configured to support said container; and a catch element connected to said frame, said catch element being positioned to extend through said opening when said container is loaded onto said frame, wherein a force is applied to said plurality of first perforations in said first row and said plurality of second perforations in said second row in an alternating manner when said catch element engages and opens said container.

2. The product dispensing system of claim 1 wherein said first row extends along a first edge between two adjacent walls of said plurality of walls, and said second row extends along a second edge between two adjacent walls of said plurality of walls.

3. The product dispensing system of claim 1 wherein said first row is substantially parallel to said second row.

4. The product dispensing system of claim 1 wherein said distance is at least 0.5 mm.

5. The product dispensing system of claim 1 wherein said distance is at least 1 mm.

6. The product dispensing system of claim 1 wherein said distance is at least 2 mm.

7. The product dispensing system of claim 1 wherein each perforation of said plurality of first perforations is formed as an elongated cut in said container.

8. The product dispensing system of claim 7 wherein said cut comprises:

an angled portion comprising a first end and a second end, said angled portion having a first length; and a longitudinal portion comprising a first end and a second end, said longitudinal portion having a second length, wherein said angled portion extends from said second end of said longitudinal portion at a non-zero angle relative to said longitudinal portion.

9. The product dispensing system of claim 8 wherein said angle is at least 20 degrees.

10. The product dispensing system of claim 8 wherein said length of said longitudinal portion is at least 0.5 mm.

11. The product dispensing system of claim 1 wherein said container comprises a plurality of products received in said internal volume.

12. The product dispensing system of claim 1 wherein said container comprises paperboard.

13. The product dispensing system of claim 1 wherein said frame comprises two opposed side walls and a support surface between said opposed side walls, said support surface having a front end and a rear end.

14. The product dispensing system of claim 13 wherein said catch element is connected to said support surface.

15. The product dispensing system of claim 13 wherein said catch element comprises a base connected to said support surface and a protrusion extending from said base.

16. The product dispensing system of claim 15 wherein said protrusion extends away from said rear end of said support surface.

17. The product dispensing system of claim 15 wherein said catch element is positioned proximate said front end of said support surface and said protrusion protrudes toward said front end of said support surface.

18. A method for dispensing products comprising the steps of:

providing a container comprising a plurality of walls that define an internal volume and an opening into said internal volume, wherein said container defines a plurality of first perforations arranged in a first row extending from said opening and a plurality of second perforations arranged in a second row extending from said opening, wherein said plurality of first perforations are staggered by a distance relative to said plurality of second perforations, wherein a plurality of products are initially received in said internal volume;

providing a dispenser comprising a frame defining a frame opening, and further configured to support said container, and a catch element connected to said frame, said catch element being positioned to extend through said first opening when said container is loaded onto said frame;

urging said container along said frame such that said catch element extends through said opening and tears said plurality of first perforations in said first row and said plurality of second perforations in said second row to form an access opening in said container, wherein a force is applied to said plurality of first perforations in said first row and said plurality of second perforations in said second row in an alternating manner when said catch element engages and opens said container; and aligning said access opening with said frame opening such that at least one product of said plurality of products moves from said container to said dispenser.

19. The method of claim 18 wherein said distance is at least 0.5 mm.

* * * * *